US009897313B2

(12) United States Patent
James

(10) Patent No.: US 9,897,313 B2
(45) Date of Patent: Feb. 20, 2018

(54) WATER-BASED SYSTEM AND METHOD OF COLLECTING AND TRANSPORTING EXHAUST GAS

(71) Applicant: Jahchinedu James, Houston, TX (US)

(72) Inventor: Jahchinedu James, Houston, TX (US)

( * ) Notice: Subject to any disclaimer, the term of this patent is extended or adjusted under 35 U.S.C. 154(b) by 45 days.

(21) Appl. No.: 14/555,827

(22) Filed: Nov. 28, 2014

(65) Prior Publication Data

US 2015/0147249 A1 May 28, 2015

Related U.S. Application Data

(60) Provisional application No. 61/909,569, filed on Nov. 27, 2013.

(51) Int. Cl.

| | |
|---|---|
| ***B01D 53/14*** | (2006.01) |
| ***B01D 53/78*** | (2006.01) |
| ***B01J 19/18*** | (2006.01) |
| ***F23J 15/06*** | (2006.01) |
| ***F23J 15/00*** | (2006.01) |

(52) U.S. Cl.

CPC ..... *F23J 15/06* (2013.01); *F23J 15/003* (2013.01); *F23J 2219/40* (2013.01); *F23J 2219/80* (2013.01)

(58) Field of Classification Search

CPC .. F23J 15/003; F23J 15/06; F23J 15/02; F23J 15/022; F23J 15/04; F23J 2219/40; F23J 2219/80; F23J 2900/01005; F23J 2900/15027; F23J 2900/15041

See application file for complete search history.

(56) References Cited

U.S. PATENT DOCUMENTS

| | | | | |
|---|---|---|---|---|
| 8,623,286 | B2 * | 1/2014 | Iijima | B01D 53/1412 422/168 |
| 8,628,741 | B2 | 1/2014 | Presswood, Jr. et al. | |
| 2008/0257236 | A1 * | 10/2008 | Green | B01D 53/78 110/215 |

* cited by examiner

*Primary Examiner* — Cabrena Holecek
(74) *Attorney, Agent, or Firm* — Global Intellectual Property Agency, LLC; Daniel Enea

(57) ABSTRACT

A system and method of collecting and transporting exhaust gases, preferably gases generated via the burning of fossil fuels, to a remote treatment facility. The exhaust gases include greenhouse gases, airborne particulates, and other pollutants. The present system comprises a gas extraction cap for collecting exhaust gas emitted from a point source of pollution, a pump for drawing water from a water source, a means for mixing the captured exhaust gas with the drawn water, a pipeline for transporting the gas-water solution to a remote treatment facility, and one or more high-pressure boilers for separating the water from the gas-water solution, leaving the exhaust gases available for treatment at the facility. Once the gas-water mixture arrives at the processing location, it then goes through one or more boiling steps in order to separate the water from the captured gases.

7 Claims, 5 Drawing Sheets

WATER-BASED SYSTEM AND METHOD OF COLLECTING AND TRANSPORTING EXHAUST GAS

CROSS REFERENCE TO RELATED APPLICATION

This application claims the benefit of U.S. Provisional Application No. 61/909,569 filed on Nov. 27, 2013. The above identified patent application is herein incorporated by reference in its entirety to provide continuity of disclosure.

FIELD OF THE INVENTION

The present invention relates to systems and methods of capturing, transporting, and treating airborne pollutants, such as greenhouses gases. The present method utilizes water, which is preferably drawn from a location near to the source of the emissions, to transport the gases to a remote processing center. The pollutant gases can then be stored and treated at this remote processing center, rather than being emitted into the atmosphere.

BACKGROUND OF THE INVENTION

Current methods of removing pollutant compounds from flue gas streams known in the prior art rely upon systems that specifically target certain types of molecules. For example, flue gas can be desulfurized via a number of different methods, including wet scrubbing of the gas emissions with an alkaline sorbent, such as limestone, in order to remove sulfur dioxide. Carbon can also be captured from flue gas using an amine treatment method. These carbon capture systems generally collect carbon, usually in the form of carbon dioxide, from the post-combustion flue gas and then transport the carbon-containing compounds to a remote facility for storage and treatment. Nitrogen oxides are generally addressed via high-temperature reactions with ammonia or urea in order to produce nitrogen gas.

Ultimately, there is no so single method currently known in the prior art that is suitable for removing or otherwise neutralizing all of the pollutants and/or greenhouse gases from a flue gas stream, therefore flue gas must be treated using a combination of methods to address all of these different types of gaseous compounds. However, because these treatment systems all take place at the point source of the pollution, there are substantial space and design constraints that prevent all of these different treatment methods from being implemented simultaneously. Therefore, there is a need in the prior art for a system adapted to efficiently collect and transport exhaust gas from a point source of pollution to a remote facility so that the collected exhaust can be treated using a combination of methods in order to reduce the levels of pollutants and/or greenhouse gases that are emitted into the atmosphere.

SUMMARY OF THE INVENTION

In view of the foregoing disadvantages inherent in the known types of exhaust collection and treatment systems now present in the prior art, the present invention provides a new water-based system and method of collecting and transporting exhaust gases wherein the same can be utilized for providing convenience for the user when seeking to minimize the amount of pollutants and/or greenhouse gases emitted into the Earth's atmosphere. The present system comprises a gas extraction cap for collecting exhaust gas emitted from a point source of pollution, a pump for drawing water from a water source, a mixer for mixing the captured exhaust gas with the drawn water, a pipeline for transporting the gas-water solution to a remote treatment facility, and one or more high-pressure boilers for separating the water from the gas-water solution, leaving the gases available for treatment at the facility.

The extraction cap is fitted onto a flue, a flare stack, or any other such pollution source and is adapted to completely collect all of the exhaust gas emitted therefrom. The captured gases are then mixed with water, which serves as a transport medium to facilitate the transport of these exhaust gases to a remote facility for processing. When the gases are mixed with water, some of the gases chemically react with the water to form a new compound and the remaining gases are simply dissolved into the water stream or simply drawn along therewith. Furthermore, any particulates contained within the exhaust gas are also drawn along through the pipeline system with the water. When the water is removed from the transported gas-water mixture via the boiler or system of boilers, the resulting greenhouse gases, particulates, and other pollutants are then available for individual processing within the enclosed system of the facility.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
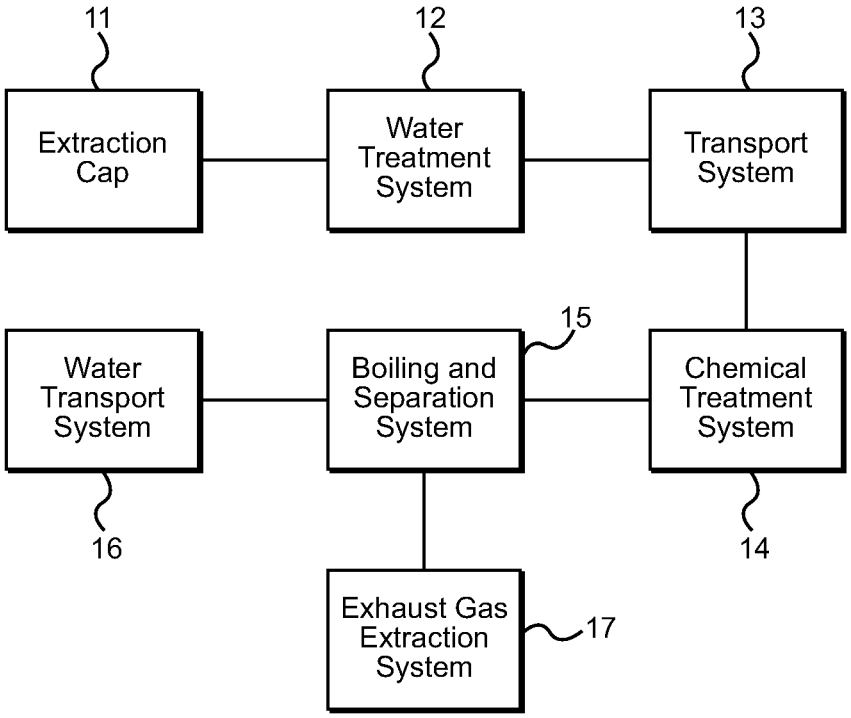
FIG. 1 shows a diagram of the components of the present system.

Reference is made herein to the attached drawings. Like reference numerals are used throughout the drawings to depict like or similar elements of the system and method of collecting and transporting exhaust gas. For the purposes of presenting a brief and clear description of the present invention, the preferred embodiment will be discussed as used for collecting flue gas emitted as a result of the combustion of fossil fuels or gas emitted by flare stacks. The figures are intended for representative purposes only and should not be considered to be limiting in any respect.

The present invention is a system adapted to collect exhaust gas containing greenhouse gases and other pollutants originating from industrial sources, such as flue gas emitted as a result of the combustion of fossils fuels, pollutant gases emitted from a flare stack, and the like. The present system then mixes the captured gases with water, which is preferably drawn from a location near the source of the emissions, for ease of transporting the gases to a remote processing location. Once the gas-water mixture arrives at the processing location, it then goes through one or more boiling steps in order to separate the water from the captured gases. Once separated, the potable water is then available for other uses and the pollutants are available for further treatment at the processing location. The present invention thereby provides a system for capturing greenhouse gas emissions so that they can processed, and preferably neutralized, at a remote location, rather than them being released into the atmosphere.

As used herein, "pollutants" refers to greenhouse gases, particulates (e.g. soot) created as a result of the combustion of fossil fuels, and other gaseous compounds that have a negative impact on the environment, such as sulfur dioxide. Furthermore, "greenhouse gases" refers to carbon dioxide, nitrogen oxides, methane, fluorinated gases, and other such gases. Still further, "exhaust gas" refers to flue gas emitted as a result of the combustion of fossils fuels, gases emitted from a flare stack, and other such gases containing pollutants, greenhouse gases, and/or particulates emitted from an industrial source. Still further, a "point source of pollution" refers to a flue, a flare stack, and the like.

Referring now to FIG. 1, there is shown a diagram of the components of the present system. The present invention comprises an extraction cap 11 that is adapted to be fitted to a point source of pollution and a water pump and mixing system 12 that is connected thereto. The extraction cap 11 is provided in a number of different embodiments that are specifically designed to be fitted to different types of point sources of pollution, such as a flue or a flare stack. The extraction cap comprises a first open end, which is adapted to be situated about a point source of pollution, and a second open end to which the transport system 13 is attached. The extraction cap 11 comprises a blower or another such means for drawing the exhaust gas emitted from the point source of pollution into the interior volume of the extraction cap 11 in order to prevent the exhaust gas from being transmitted into the atmosphere. The enclosed interior volume of the extraction cap 11 collects exhaust gas being emitted and the combination of the blower disposed therein and the water pumped into the extraction cap 11 via the water pump and mixing system 12 forces the exhaust gas from the interior volume of the extraction cap 11 into the transport system 13 connected thereto. The extraction cap 11 is composed of heat-resistant materials that are adapted to resist the high temperatures associated with heated flue exhaust and flare stacks.

The water pump and mixing system 12 comprises a pump that is adapted to draw water from a water source and transport it to an extraction cap 11, a series of sprinklers disposed along the interior surface of the extraction cap 11 that serve to cool the incoming exhaust gas and direct it to the second open end of the extraction cap 11 and into the transport system 13. Once in the transport system 13, the exhaust gas and the water are then physically mixed via one or more motors and one or more pumps. This physical mixing of the water pump and mixing system 12 results in some of the exhaust gas chemically reacting with the water to form new compounds (e.g. carbon dioxide reacting with water to form carbonic acid) and the remaining exhaust gas compounds dissolving into the water. Particulates that are too large to dissolve into the water are instead simply physically driven through the transport system 13 via the action of the motors and the pumps. By mixing the exhaust gas with water, the resulting gas-water mixture can be transported easily and efficiently through the pipes of the transport system 13.

The transport system 13 comprises a pipe system connecting the extraction cap 11, which is at the site of the site of the point source of pollution, and the separation system 15, which is disposed at a remote location. The transport system 13 comprises pumps disposed along the length of the pipes that are adapted to drive the gas-water mixture therethrough to the subsequent systems. In one embodiment, the present system further comprises a chemical treatment system 14 disposed along the transport system 13, prior to the separation system 15. The chemical treatment system 14 pretreats the gas-water mixture with additional chemicals to assist in the neutralization of the greenhouse gases and other pollutants contained within the gas-water mixture. The pretreatment chemicals comprise desulfurization compounds, amines adapted to isolate carbon-containing compounds, ammonia or urea to react with nitrogen oxides to form nitrogen gas, and other chemicals known in the art that are adapted to neutralize or isolate pollutants or greenhouse gases commonly found within exhaust gas. In some embodiments of the present invention, the pretreatment chemicals act to immediately drop the targeted compound out of solution so that they can be filtered from the gas-water mixture as it enters the separation system 15, prior to being the mixture being boiled. In another embodiment of the present invention, the pretreatment chemicals remain in solution with the gas-water mixture and act upon the targeted compounds only after the water is separated from the mixture at the processing facility.

The separation system 15 comprises an entry point at which the gas-water mixture enters, a boiler, a condenser, and a means for removing the resultant greenhouse gases, pollutants, and particulates for transport. The boiler raises the temperature of the gas-water mixture such that the water turns to steam. The steam is then siphoned off from the boiler, separating the water from the exhaust gas and chemical compounds contained with the gas-water mixture. The steam is then transported through a filter in order to minimize any particulates or other compounds that may be transported therewith, and then through a condenser. After the steam is condensed back to water, the separated and filtered water is then tested for purity. If the water is potable or otherwise satisfies purity standards, then the water is transported 16 from the present system. If the separated and filtered water does not satisfy purity standards, then it is recirculated through the boiling, separating, filtering, and condensing systems until all impurities are removed.

After the exhaust gas compounds are separated from the water, they are then removed from the separation system 15 and transmitted to the extraction system 17. At the extraction system 17, the resultant exhaust gas compounds can then be treated so that they are isolated and neutralized via means known in the prior art. The water mixed with the collected exhaust gases acts as a transport medium for transporting the gases from the collection location at the point source of pollution to the remote treatment facility.

Figure 2:
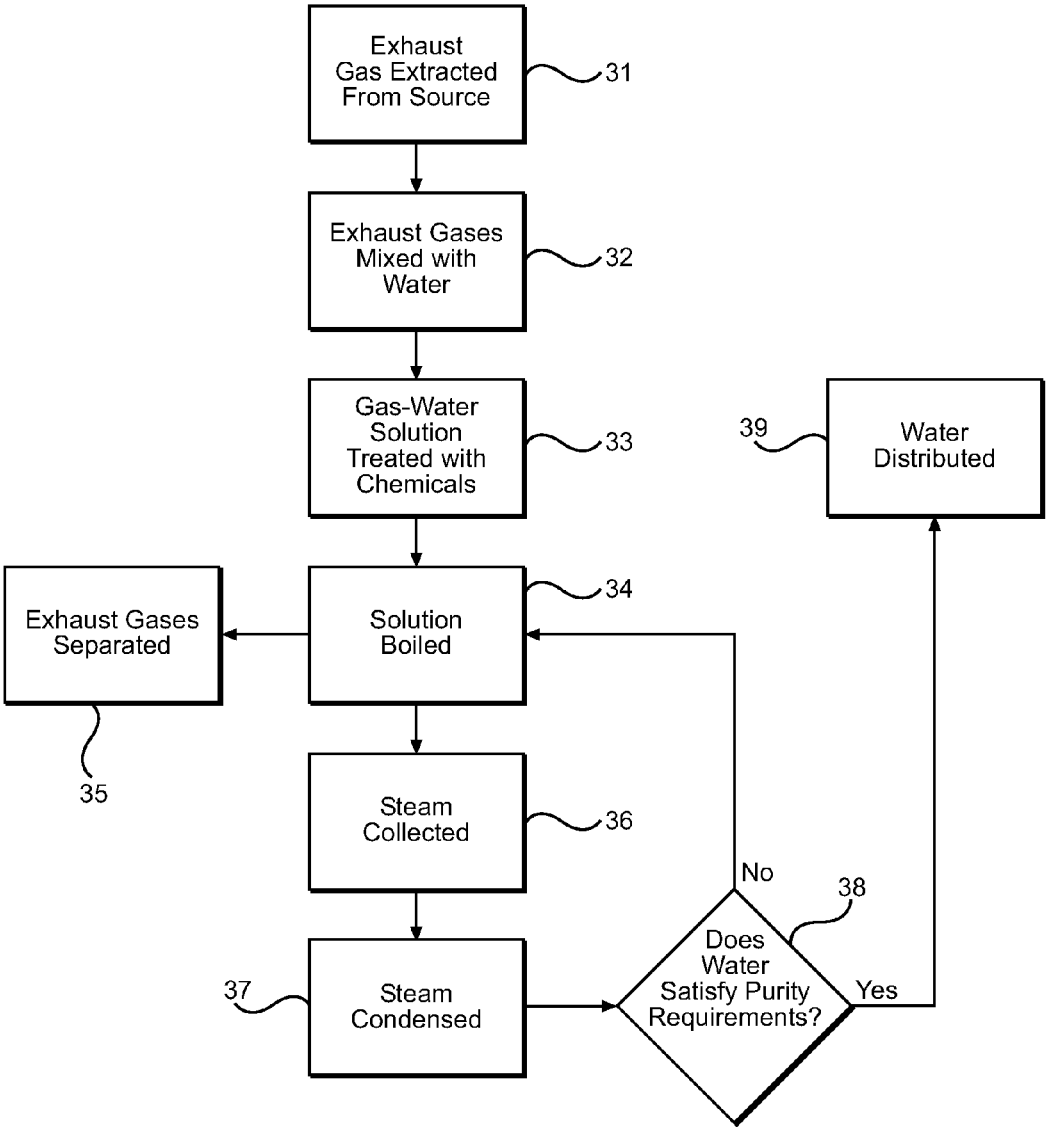
FIG. 2 shows a diagram of the method of the present system.

Referring now to FIG. 2, there is shown a diagram of the method of the present system. The present method, embodied by the components discussed above, comprises the following steps. First, the exhaust gas, which comprise greenhouse gases, particulates, and other pollutants, are collected and extracted 31 from the point source of the pollution via the extraction cap, as described above. The exhaust gas is then physically mixed with water 32 via a series of sprinklers installed along the interior of the extraction cap, which assists in forcing the collected exhaust gas from the extraction cap into the transport system. Once inside the transport system, i.e. the series of pipes connecting the extraction cap to the remote treatment facility, a series of pumps propel the gas-water mixture therealong and assist in further mixing the exhaust gas into the water. Prior to reaching the treatment facility containing the boiler system, the gas-water mixture may be pretreated with chemicals 33. The pretreatment chemicals comprise desulfurization compounds, amines adapted to isolate carbon-containing compounds, ammonia or urea to react with nitrogen oxides to form nitrogen gas, and other chemicals known in the art that are adapted to neutralize or isolate pollutants or greenhouse gases commonly found within exhaust gas.

Once the gas-water mixture reaches the treatment facility, the mixture is boiled 34 in order to separate the water, as steam, from the exhaust gas compounds. At this point, the exhaust gas compounds drop out of solution 35 and can then be collected for individual treatment. Simultaneously, the steam generated from the boiling process is collected 36 and condensed 37 back to water. The condensed water can then be tested 38 to determine whether is satisfies objective purity requirements. If is satisfies those objective criteria, then it is free to be re-distributed 38 as needed. If it does not satisfy those objective criteria, then it is re-boiled 34, collected 36, and condensed 37 until the water is completely separated from the compounds from the exhaust gas and has the requisite level of purity. For each boiling cycle, the exhaust gas compounds drop out of solution 35 and are collected for individual treatment. The present system and method utilizes water as a transport medium to carry collected greenhouse gases from a point source of pollution to a remote treatment facility, at which point the exhaust gases are separated therefrom so that they can be treated and neutralized utilizing appropriate, compound-specific methods without the need to perform all of the different types of treatment steps on-site at the point source of the pollution.

Figure 3:
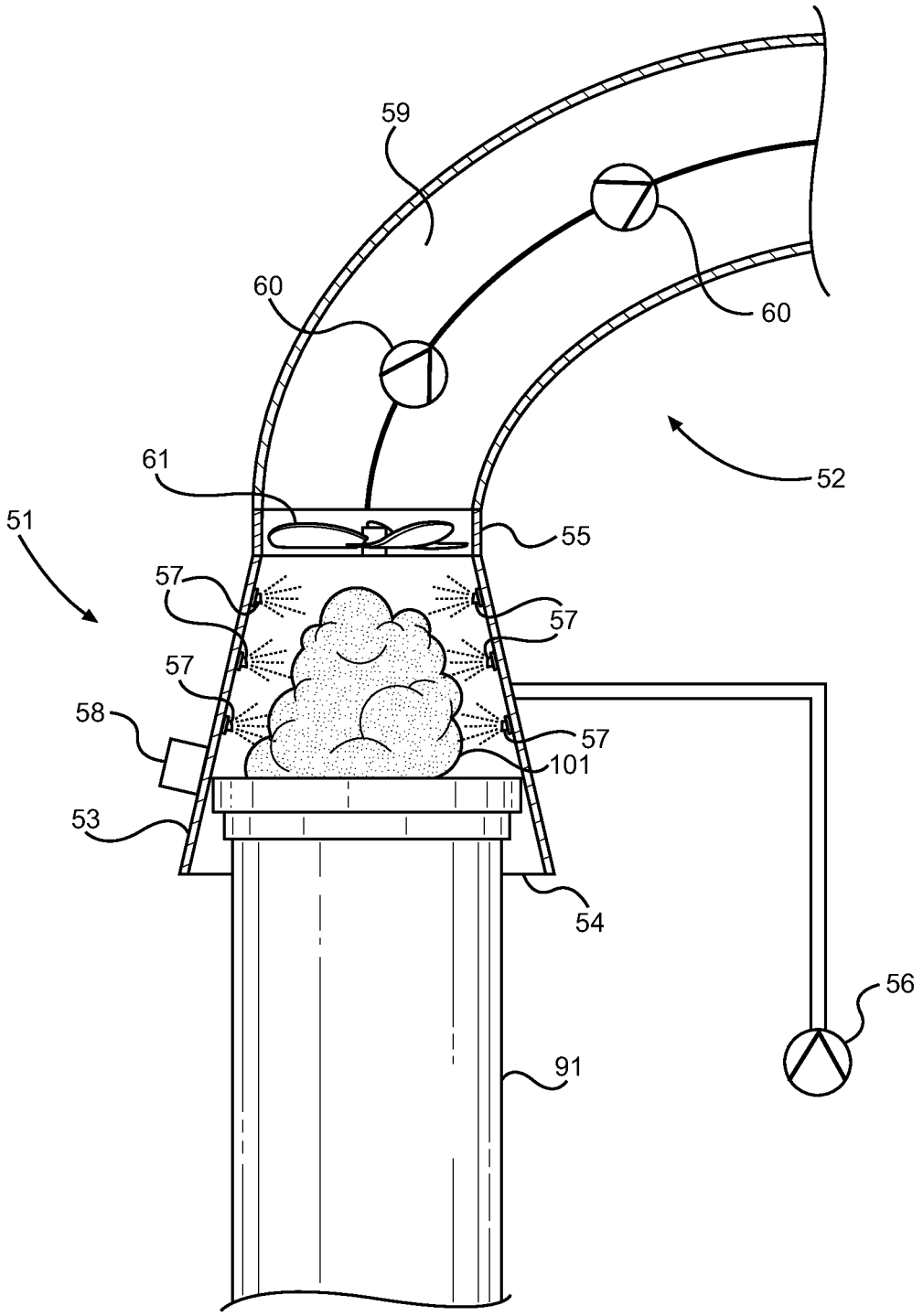
FIG. 3 shows a first embodiment of the gas extraction cap of the present invention.

Referring now to FIG. 3, there is shown a first embodiment of the gas extraction cap of the present invention. The first embodiment of the gas extraction cap 51 is adapted to be affixed to a smokestack 91. The first embodiment of the gas extraction cap 51 comprises a housing 53 having a first end 54 adapted to be affixed to a smokestack 91 and a second end 55 adapted to be connected to the transport system 52. The first embodiment of the extraction cap 51 further comprises a blower 61 adapted to pull exhaust gas 101 through the extraction cap 51, into the transport system 52 so that it can be transported to the remote facility for processing.

The extraction cap 51 further comprises a plurality of sprinklers 57 disposed on the interior surface of the housing 53. The sprinklers 57 are angled so that they assist the blower 61 in communicating exhaust gas 101 from the interior volume of the housing 53 to the transport system 52. The sprinklers 57 preferably draw water from a nearby water source via a pump 56 that is connected thereto. In addition to assisting in communicating exhaust gas 101 from the extraction cap 51 to the transport system 52, the sprinklers 57 also act to begin cooling the exhaust gas 101 and begin the process of mixing the exhaust gas 101 with water for transport. An alternative embodiment of the extraction cap 51 further comprises an emergency-release 58 for venting exhaust gas 101 from the interior volume of the extraction cap 51 when the pressure therein reaches dangerously high levels. The emergency-release 58 can be automatically triggered by an internal pressure sensor or manually triggered.

The transport system 52 connects the extraction cap 51 to a remote treatment facility (not shown). The extraction cap 51 comprises piping 59 and a plurality of pumps 60 disposed therealong. The pumps 60 act to mix the exhaust gas 101 with the water introduced into the piping 59 and propel the gas-water mixture therealong to the remote treatment facility for processing. The water acts as a transport medium for the exhaust gas 101, chemically reacting with some of the exhaust gas compounds 101 and dissolving the non-reactive exhaust gas 101 compounds.

Figure 4:
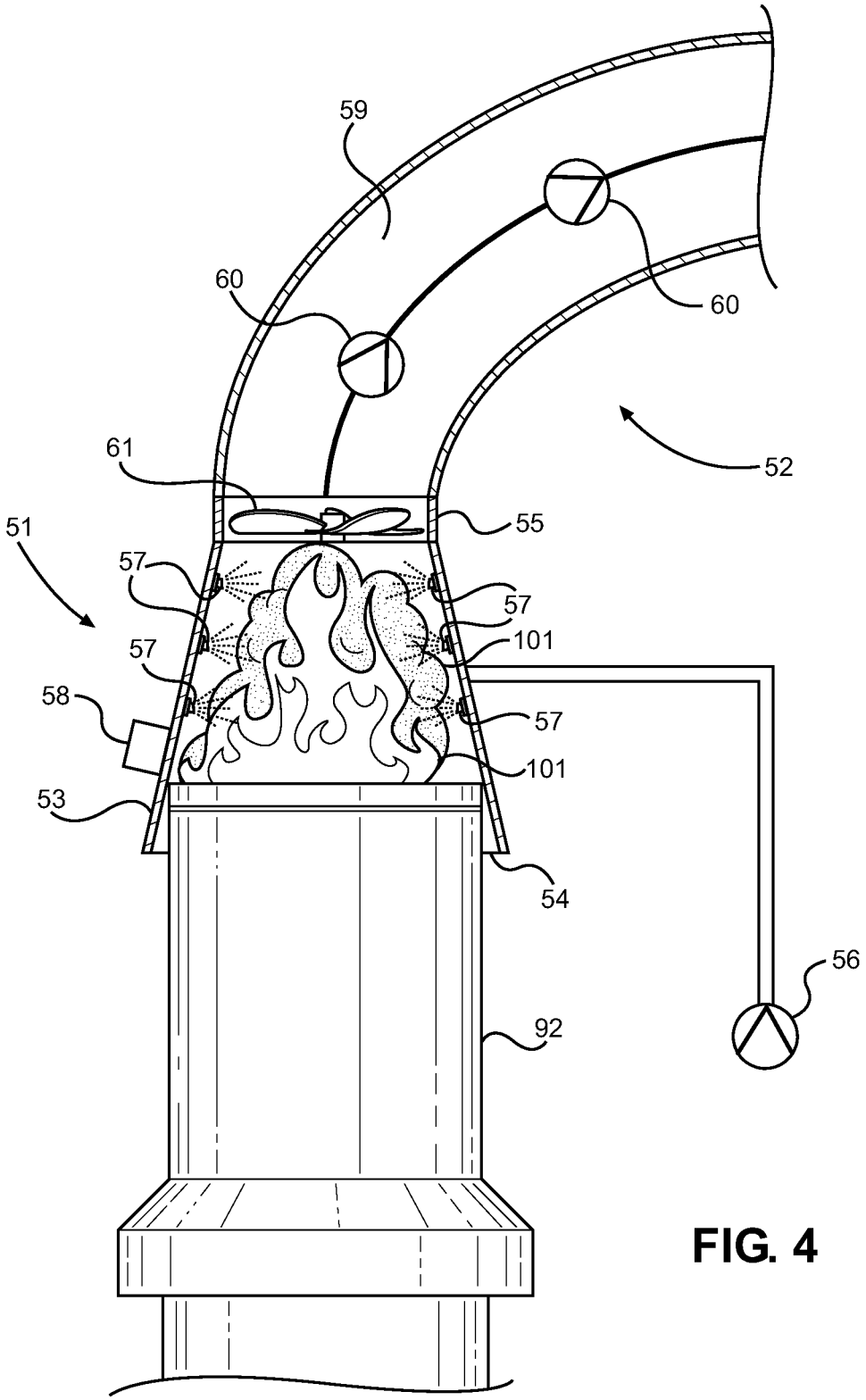
FIG. 4 shows a second embodiment of the gas extraction cap of the present invention.

Referring now to FIG. 4, there is shown a second embodiment of the gas extraction cap of the present invention. The second embodiment of the gas extraction cap 51 is adapted to be affixed to a flare stack 92. Although alterations to the composition and design of the housing 53 of the extraction cap 51 are necessary to accommodate the higher temperatures associated with the fire generated by the flare stack 92, the principal of the operation of the second embodiment of the extraction cap 51 is otherwise identical to that of the first embodiment of the extraction cap 51. The housing 53 completely contains the discharge end of the point source of pollution, i.e. the flare stack 92, and captures all of the exhaust gas 101 emitted therefrom. A blower 61 draws the exhaust gas 101 from the interior volume of the housing 53 and transmits it to the transport system 52. A plurality of sprinklers 57 disposed along the interior surface of the housing 53 cool the exhaust gas 101 emitted from the flare stack 92, begin the process of mixing the exhaust gas 101 with water, and assist in directing the exhaust gas 101 from the interior volume of the housing 53 to the transport system 52 connected thereto.

Figure 5:
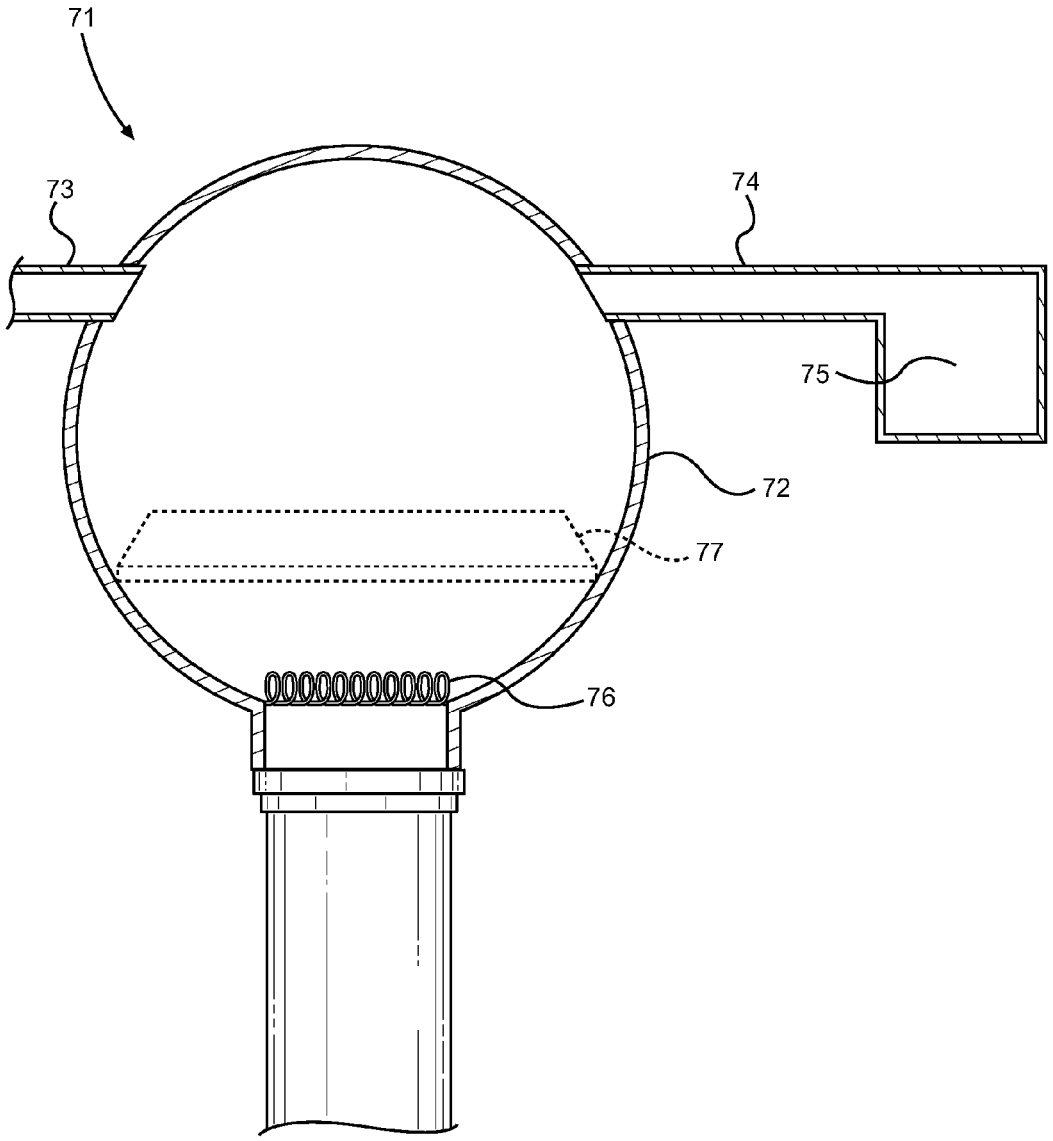
FIG. 5 shows an embodiment of the boiling chamber of the present invention.

Referring now to FIG. 5, there is shown an embodiment of the boiling chamber of the present invention. The boiling chamber 71 comprising a housing 72, an inlet 73 connected to the transport system for conveying the gas-water mixture to the boiling chamber 71, a base surface 77 on which the gas-water mixture is supported, a heating element 76, and a steam collector 74 for collecting the water that has boiled and separated from the exhaust gas components of the mixture. As the heating element 76 raises the temperature within the housing 72, the water of the gas-water mixture supported on the base surface 77 turns to steam, at which point it separates from the other compounds in the mixture that have a higher boiling point. The steam is then siphoned off via the steam collector 74, which then transmits the steam to a condenser 75 to be condensed back to water for testing. The steam collector 74 comprises a vent with a blower for removing the low-density steam that has risen to the top portion of the housing during the boiling process, a cooled funnel that causes the steam to condense when the steam comes in contact therewith, or another such means of siphoning steam from the remaining solution. Once the boiling process has completed, the heating element 76 is deactivated and the boiler 71 is allowed to return to ambient temperature. Once the boiler 71 has cooled, the remaining compounds with the water separated therefrom may be removed from the boiler 71 for additional processing.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exhaust gas collecting and transport system, comprising:

an extraction cap adapted to be attached to a point source of pollution;

a water pump adapted to draw water from a water source and transmit said water to said extraction cap;

a mixer adapted to mix exhaust gas emitted from said point source of pollution with said water, creating a gas-water solution;

a transport system adapted to connect said extraction cap to a boiler;

said transport system comprising one or more pumps disposed therealong for transmitting said gas-water solution to said boiler;

said boiler comprising a heating element and a steam collector;

said steam collector adapted to siphon steam generated via heating of said gas-water solution by said heating element, removing said water from said gas-water solution; and a condenser in communication with said steam collector.

2. The exhaust gas collecting and transport system of claim 1, wherein said point source of pollution comprises a flue.

3. The exhaust gas collecting and transport system of claim 1, wherein said point source of pollution comprises a flare stack.

4. The exhaust gas collecting and transport system of claim 1, wherein said mixer comprises a plurality of sprinklers disposed on an interior surface of said extraction cap.

5. The exhaust gas collecting and transport system of claim 1, wherein said mixer comprises a plurality of pumps disposed along the length of said transport system.

6. The exhaust gas collecting and transport system of claim 1, wherein said mixer comprises a plurality of sprinklers disposed on an interior surface of said extraction cap and a plurality of pumps disposed along the length of said transport system.

7. The exhaust gas collecting and transport system of claim 1, further comprising a chemical treatment system adapted to treat said gas-water solution with one or more pretreatment chemicals prior to being transmitted to said boiler.

* * * * *